US012270587B2

(12) United States Patent
Grohmann et al.

(10) Patent No.: US 12,270,587 B2
(45) Date of Patent: Apr. 8, 2025

(54) APPARATUS AND METHOD FOR GENERATING CRYOGENIC TEMPERATURES AND USE THEREOF

(71) Applicant: Karlsruher Institut für Technologie, Karlsruhe (DE)

(72) Inventors: Steffen Grohmann, Weingarten (DE); Eugen Shabagin, Sandhausen (DE); David Gomse, Munich (DE)

(73) Assignee: Karlsruher Institut für Technologie, Karlsruhe (DE)

( * ) Notice: Subject to any disclaimer, the term of this patent is extended or adjusted under 35 U.S.C. 154(b) by 1 day.

(21) Appl. No.: 17/996,626

(22) PCT Filed: Apr. 22, 2021

(86) PCT No.: PCT/EP2021/060539
§ 371 (c)(1),
(2) Date: Oct. 20, 2022

(87) PCT Pub. No.: WO2021/214225
PCT Pub. Date: Oct. 28, 2021

(65) Prior Publication Data

US 2023/0204258 A1 Jun. 29, 2023

(30) Foreign Application Priority Data

Apr. 23, 2020 (DE) ..... 102020205183.6

(51) Int. Cl.
*F25B 9/00* (2006.01)
*F25B 9/02* (2006.01)
*F25B 41/39* (2021.01)

(52) U.S. Cl.
CPC ..... *F25B 9/006* (2013.01); *F25B 9/02* (2013.01); *F25B 41/39* (2021.01); *F25B 2400/23* (2013.01)

(58) Field of Classification Search
CPC .. F25B 9/006; F25B 9/02; F25B 41/39; F25B 2400/23
(Continued)

(56) References Cited

U.S. PATENT DOCUMENTS 5,063,747 A 11/1991 Jones et al.
6,380,544 B1 * 4/2002 Broerman ..... F17C 13/087 250/370.15
(Continued)

FOREIGN PATENT DOCUMENTS

EP 1813889 A1 8/2007
EP 2562489 A1 2/2013
(Continued)

OTHER PUBLICATIONS

Kochenburger, T, Kryogene Gemischkaltekreislaufe fur Hochtemperatursupraleiter-Anwendungen (Cryogenic Mixed Refrigerant Circuits for High-Temperature Superconducting Applications), doctoral thesis, Karlsruhe Institute of Technology, 2019, ISBN 978-3-8439-3987-4, 16 pages, Jan. 1, 2019.

*Primary Examiner* — Steve S Tanenbaum
(74) *Attorney, Agent, or Firm* — Woodard, Emhardt, Henry, Reeves & Wagner, LLP

(57) ABSTRACT

The invention relates to an apparatus (112) and to a method (210) for generating cryogenic temperatures. The apparatus (112) comprises at least one cooling stage (111) which has a cold region (110) and a warm region (116), and a refrigerant mixture designed specifically for the cooling stage (111) is provided in the warm region (116), the refrigerant mixture having at least two components each having a different boiling temperature, and the cold region (110) comprises at least one cooling stage (111): —a first heat exchanger (122), which has a high-pressure side (120) to receive the refrigerant mixture at a high-pressure level from the warm region (116) of the cooling stage (111) and a low-pressure side (126) to deliver the refrigerant mixture to the warm region (116) of the cooling stage (111); —a first expansion device (136), which is designed for expansion and for cooling of the refrigerant mixture at a low-pressure level; —a second heat exchanger (148), which is designed for cooling and for partial condensation of a proportion of the refrigerant mixture located in a buffer volume (140), the buffer volume (140) being designed to limit the pressure
(Continued)

exerted by the refrigerant mixture; and —a second expansion device (150), which is designed for separation of the buffer volume (140) from the low-pressure level of the cooling stage (111) or connection of the buffer volume (140) to said low-pressure level. The invention enables autonomous operation of the apparatus (112) and of the method (210) for generating cryogenic temperatures, in which each cooling stage (111) of the apparatus (112) can be filled with a pre-defined refrigerant mixture and can be permanently operated, and in particular in the cooling phase the refrigerating capacity can be increased, while incorrect distribution of the refrigerant of the relevant cooling stage (111) among parallel flow channels at the cold end of the first heat exchanger (122) can be prevented.

7 Claims, 4 Drawing Sheets

(58) Field of Classification Search
USPC ..... 62/114
See application file for complete search history.

(56) References Cited

U.S. PATENT DOCUMENTS

| | | | | |
|---|---|---|---|---|
| 6,427,483 | B1 | 8/2002 | Rashad et al. | |
| 6,595,009 | B1 | 7/2003 | Howard et al. | |
| 6,666,046 | B1 | 12/2003 | Lockett et al. | |
| 2005/0223714 | A1 | 10/2005 | Li et al. | |
| 2006/0026968 | A1 | 2/2006 | Gao | |
| 2010/0139297 | A1 | 6/2010 | McCormick et al. | |
| 2019/0226724 | A1 * | 7/2019 | Kotsubo ..... | F25B 9/145 |

FOREIGN PATENT DOCUMENTS

| | | | |
|---|---|---|---|
| EP | 2988076 | A1 | 8/2019 |
| JP | S4869147 | A | 9/1973 |
| JP | S63286669 | A | 11/1988 |
| JP | H08222429 | A | 8/1996 |
| JP | 2002243360 | A | 8/2002 |
| JP | 2005003308 | A | 1/2005 |
| WO | 2009072900 | A1 | 6/2009 |

* cited by examiner

APPARATUS AND METHOD FOR GENERATING CRYOGENIC TEMPERATURES AND USE THEREOF

FIELD OF THE INVENTION

The invention relates to an apparatus and method for generating cryogenic temperatures, especially for liquefaction of low-boiling fluids at a temperature of 15 K to 120 K and for cooling of high-temperature superconductors to a temperature of 15 K to 90 K. However, other applications are possible.

PRIOR ART

Closed-circuit cooling for liquefaction or reliquefaction of low-boiling fluids at temperatures of 15 K to 120 K or for cooling of high-temperature superconductors, especially of power supplies for high-temperature superconducting applications, to temperatures of 15 to 90 K is of high significance for many applications, especially in energy technology and hydrogen technology. As set out in detail in T. Kochenburger, *Kryogene Gemischkältekreisläufe für Hochtemperatursupraleiter-Anwendungen* [*Cryogenic Mixed Refrigerant Circuits for High-Temperature Superconducting Applications*], doctoral thesis, Karlsruhe Institute of Technology, 2019, ISBN 978-3-8439-3987-4, preference is given to using cryogenic mixed refrigerant circuits for this purpose. By the Linde-Hampson cycle process in particular, it is possible to achieve cryogenic temperature below 120 K. In this case, the desired cooling is achieved via the Joule-Thomson effect, which describes a change in temperature in the case of adiabatic isenthalpic expansion of a real fluid. In order for cooling to be achieved, the Joule-Thomson coefficient defined according to equation (1), $$\mu_{JT} = \left(\frac{\partial T}{\partial p}\right)_H, \tag{1}$$

where the term $$\left(\frac{\partial T}{\partial p}\right)_H$$

denotes a partial derivative of the temperature T with respect to pressure p at constant enthalpy H and hence expansion, has a positive value. This condition is met over a wide range of states of many fluids, or can be achieved by preliminary cooling of fluids. Since, even in the case of large pressure differentials, a reduction in temperature by more than 100 K is achievable only with low efficiency in practice, if at all, cryogenic temperatures below 120 K are achieved by precooling the fluid by using an internal countercurrent heat exchanger (recuperator) prior to expansion.

The Linde-Hampson cycle process commences in a compressor in which a fluid coolant is compressed to a high pressure, with release of any energy of compaction that arises here in a downstream cooler to an environment of the compressor. Subsequently, the coolant is cooled down in a countercurrent heat exchanger. In an expansion unit, preferably selected from an expansion valve, a throttle capillary, a diaphragm and a sinter element, the coolant expands adiabatically to a low pressure level and cools down further by using the Joule-Thomson effect given a positive Joule-Thomson coefficient $\mu_{JT}$. Subsequently, it is possible to absorb a heat flow from an application to be cooled, especially the high-temperature superconductor, in an evaporator. Finally, the coolant is heated again to ambient temperature in the countercurrent heat exchanger that acts as a recirculating cooler, before flowing back to the compressor. If the cycle process is used to cool power supplies or for liquefaction of low-boiling fluids, for example hydrogen, a heat flow is also absorbed by the coolant within the countercurrent heat exchanger from the power supply or the fluid to be cooled.

In order to improve the efficiency of the Linde-Hampson cycle process, any resultant generation of entropy can be reduced by changes in the cycle process, for example use of multistage compressions, multistage heat exchangers or turbines for expansion. A consequence, however, is a higher complexity of the cycle process, which is manifested in a rise in expenditure for the execution thereof and more complicated control of the cycle process.

Alternatively or additionally, it is possible to alter thermodynamic properties of the coolant by having at least one further coolant having a boiling point different than the coolant. In what is called a "cryogenic mixed refrigerant circuit", the Linde-Hampson cycle process is implemented not with a pure substance but with a multicomponent mixture having a wide boiling range as coolant, in which case the cycle process takes place predominantly in a biphasic region of the mixture. In the case that the cycle process is executed in the form of at least two cooling stages, each cooling stage may preferably have a dedicated multicomponent mixture having a wide boiling range, such that the cycle process in each cooling stage takes place predominantly in a biphasic region of the respective coolant mixture. As a result, the coolant mixture can reach its dew point even at the warm end of its cooling stage, for example close to ambient temperature in the first cooling stage, and is then gradually condensed during the cooling operation and subcooled further after passing the boiling point. The Joule-Thomson expansion thus takes place partly in subcooled form, partly with high liquid fractions. By choice of the composition of the coolant mixture of a cooling stage, it is possible here to control the effective heat capacity of the coolant streams of the cooling stage in question in the countercurrent heat exchanger such that the temperature differential is reduced to a minimum both between the coolant streams of the cooling stage, preferably relative to a coolant mixture in at least one further cooling stage or relative to a gas stream to be liquefied or cooled, preferably over the entire flow length of the countercurrent heat exchanger. A further aspect may be the breakdown of the fluid into two liquid phases that occurs in some coolant mixtures. It is possible here to distinguish the two liquid phases in terms of polarity, level of fluorination or chain length of their components.

A temperature span of about 300 K between the recirculating cooler and 15 K to 120 K after an isenthalpic expansion for liquefaction of the low-boiling fluids or 15 K to 90 K for cooling of high-temperature superconductors that has to be bridged here can be considered to be very large. The cycle process can preferably be effected in one cooling stage up to a temperature of 80 K to 90 K after isenthalpic expansion. For temperatures in the evaporator of 15 K to 90 K, by contrast, the cycle process can preferably be effected in multiple stages in order to prevent higher-boiling components of the coolant from freezing out. In a multistage cycle process, it is especially also possible for an upstream cooling stage referred to as "precooling stage" to serve especially for precooling of the coolant mixture of the cooling stage in question.

In order to achieve efficient cooling, it is possible to correspondingly adjust the thermodynamic properties of the coolant used in a cooling stage. An efficient coolant mixture has a dew point which, at high pressure level, is close to the recooling temperature of the cooling stage in question. While the recooling temperature in the first cooling stage is typically in the region of ambient temperature, the recooling temperature of a cooling stage in multistage processes is in the region of the coolant temperature generated by the isenthalpic expansion of the upstream cooling stage. The dew point temperature of a cooling stage can be influenced especially via choice and fractions of higher-boiling components for the cooling stage in question. The boiling temperature of the coolant mixture in a cooling stage should preferably be just below the cooling temperature at the low pressure level, in order to minimize the generation of entropy by a high liquid fraction in the expansion in the expansion unit. The selection and fractions of lower-boiling components have a considerable influence here on the boiling temperature. In order to achieve the desired high efficiency in each case with the above-specified temperature ranges, the coolant mixture for a cooling stage thus comprises both higher-boiling components and lower-boiling components, as a result of which the coolant mixture for a cooling stage has a wide boiling range overall. In practice, the coolant mixture for the first stage may therefore preferably comprise about four to five coolants having higher boiling points and lower boiling points, preferably selected from hydrocarbons and fluorinated hydrocarbons that are mixed in a ratio matched to the intended use, and preferably fractions of low-boiling components, especially selected from oxygen, nitrogen, argon, neon, hydrogen and helium. The coolant mixture which is used for a further cooling stage, which is precooled by an upstream cooling stage, may in practice comprise about two to four coolants having higher and lower boiling points, preferably selected from oxygen, nitrogen, argon, neon, hydrogen and helium, which are mixed in a ratio matched to the intended use, where no components that can freeze out at temperatures in the cooling stage in question are selected in each case.

In addition, small gradients for heat transfer contribute to a high efficiency in the countercurrent heat exchanger. However, the small gradients simultaneously require a large area for transfer of a particular energy. In practice, the demands with regard to compactness and heat transfer area can be achieved by microstructure heat exchangers having a multitude of parallel microstructure of flow channels. However, there can be maldistribution of the coolant here at the cold end of the heat exchanger, especially in the case of biphasic states of the coolant. In cryogenic applications, there is maldistribution particularly when strands in a mutually parallel arrangement cool down at different speeds. In a colder strand—with the same pressure drop as in a warmer strand—a higher fluid density leads to a greater mass flow, as a result of which the strand cools down even more quickly, such that there is barely any flow through the warmer strand and hence part of the heat exchanger ultimately barely takes part in the heat transfer.

In order to remedy this problem, cooling, commencing at ambient temperature of about 300 K, was accomplished by first using a coolant mixture that comprised exclusively higher-boiling components that liquefied at the cold end of the heat exchanger. In this way, it was possible to flood all parallel entry passages of the countercurrent heat exchanger on the low pressure side with liquid coolant, which avoided the maldistribution of the coolant at the cold end of the heat exchanger. With increasing cooling of the apparatus, lower-boiling components were added stepwise to the coolant mixture, such that optimal operation of the heat exchanger was possible later on even in the case of cryogenic temperatures without maldistribution of the coolant at the cold end of the heat exchanger. A disadvantage of this solution, however, is the stepwise manual mixing of further components into the coolant mixture.

Devices and methods for generating cryogenic temperatures and the use thereof are known from U.S. Pat. No. 6,595,009 B1, U.S. Pat. No. 5,063,747 A, US 2006/026968 A1, US 2005/0223714 A1 and U.S. Pat. No. 6,666,046 B1.

Proceeding therefrom, it is an object of the present invention to provide a device and a method for generating cryogenic temperatures and for a use thereof, which at least partly overcome the detailed disadvantages and limitations of the prior art.

More particularly, autonomous operation of the device and of the method for generation of cryogenic temperatures is to be enabled, such that the device can be filled and operated in a sustained manner with a predefined coolant mixture. What is to be achieved here is an increase in refrigeration performance, particularly in the cooling phase, and avoidance of maldistribution of the coolant between parallel flow channels at the cold end of a countercurrent heat exchanger.

DISCLOSURE OF THE INVENTION

This object is achieved by a device and a method for generating cryogenic temperatures and a use thereof according to the features of the independent claims. Advantageous embodiments that are implementable individually or in any combination are described in the dependent claims.

The words "have", "possess", "comprise" or "include" or any grammatical variants thereof are used hereinafter in a non-exclusive manner. Accordingly, these terms may relate both to situations in which no further features are present aside from the features introduced by these words, or to situations in which one or more further features are present. For example, the expression "A has B", "A possesses B", "A comprises B" or "A include B" may relate both to the situation in which, apart from B, no further element is present in A (i.e. to a situation in which A consist exclusively of B) and to a situation in which, in addition to B, one or more elements are present in A, for example element C, elements C and D or even further elements.

In addition, it is pointed out that the expressions "at least one" and "one or more" and grammatical variants of these expressions, when they are used in connection with one or more elements or features and are intended to express the fact that the element or feature may be provided once or more than once, are generally used once, for example in the first introduction of the feature or element. In any subsequent new mention of the feature or element, the corresponding expression "at least one" or "one or more" is generally not used again, but this does not limit the possibility that the feature or element may be provided once or more than once.

In addition, the expressions "preferably", "especially", "for example" or similar expressions are used in conjunction with optional features, without restriction of alternative embodiments thereby. For instance, features that are introduced by these expressions are optional features, and there is no intention by virtue of these features to restrict the scope of protection of the claims and especially of the independent claims. For instance, the invention, as the person skilled in the art will appreciate, can also be conducted using different embodiments. In a similar manner, features that are introduced by "in one embodiment of the invention" or by "in one working example of the invention" are understood to be optional features without any restriction thereby of alternative embodiments or the scope of protection of the independent claims. In addition, these introductory expressions shall have no effect on any of the options of combining the features introduced thereby with other features, whether they are optional or non-optional features.

In a first aspect, the present invention relates to a device for generating cryogenic temperatures. The device configured to generate cryogenic temperatures can also be referred to as "refrigeration system". The expression "cryogenic temperature" here encompasses a temperature from 10 K, preferably from 15 K, up to 120 K, preferably to 90 K.

The device for generating cryogenic temperatures here comprises at least one cooling stage, each of which has a cold region and a warm region. The "warm region" here refers to a first subregion of the device that has a higher temperature compared to the cold region. In the case of at least two cooling stages, the device may be designed such that at least a portion of the warm region of the respective downstream cooling stage may correspond to the cold region of the respective upstream stage. Preferably, the warm region of the cooling stage, also referred to as "precooling stage", is configured for ambient temperature and is typically kept at least at ambient temperature, although higher temperatures, for instance up to 150° C., may occur particularly in the compressor. The expression "ambient temperature" relates here to a temperature of 273 K, preferably of 288 K, more preferably of 293 K, up to 313 K, preferably to 303 K, more preferably to 298 K.

By contrast, the "cold region" refers to a further subregion of the cooling stage in question in the device that is configured for cryogenic temperature and is intended to serve to generate the respective cryogenic temperature. Reference is made to the above definition of the term "cryogenic temperature". Especially in order to bring the cold region to a cryogenic temperature and to keep it at a cryogenic temperature, the cold region is introduced into a cryostat, preferably a vacuum-insulated cryostat. However, other types of cryostat are possible.

In the respective warm region of the cooling stage in question, a coolant mixture is provided in each case, the term "coolant" relating in each case to a preferably inert fluid which has a positive Joule-Thomson coefficient $\mu_{JT}>0$ on entry into the cold region of the cooling stage in question, and which is thus suitable for use as a means of generating the cryogenic temperature in a cooling stage of the Linde-Hampson cycle process. As already mentioned at the outset, the term "coolant mixture" refers to a mixture of at least two components of coolants, where at least two of the components have a different boiling temperature. In order to be able to achieve a high efficiency particularly in the case of cooling by the abovementioned temperature range from about 300 K down to 15 K to 90 K, or to 15 K to 120 K, the coolant mixture for the respective cooling stage in each case comprises higher-boiling components and lower-boiling components, as a result of which the coolant mixture can be described overall as "wide-boiling". Preferably, the coolant mixture for each cooling stage therefore comprises at least two, preferably at least three, more preferably at least four, up to eight, preferably up to six, preferably up to five, coolants, where at least one of the coolants is a higher-boiling component and at least one further coolant is a low-boiling component. The term "higher-boiling" relates to fluids having a boiling point which is a temperature on entry into the cold region of the respective cooling stage. For the expression "cold region", reference is made to the above definition. The term "lower-boiling" relates to fluids having a boiling point which is a temperature below the temperature of the higher-boiling component in the respective cooling stage. The lowest-boiling component of the coolant mixture in the respective cooling stage has a boiling temperature which is below the temperature after the isenthalpic expansion of the respective cooling stage and may thus especially be a cryogenic temperature. For the expression "cryogenic temperature", reference is made to the above definition. Especially for the preliminary cooling stage, it is possible here for the at least one higher-boiling component preferably to be selected from a hydrocarbon and a fluorinated hydrocarbon, while the at least one low-boiling component may preferably be selected from oxygen, nitrogen, argon, neon, hydrogen and helium. The coolant mixture for a further cooling stage which is precooled by a preceding preliminary cooling stage may preferably comprise a coolant selected from oxygen, nitrogen, argon, neon, hydrogen and helium, which are preferably mixed in a ratio matched to the appropriate application, preference being given to avoiding those components in each case that can freeze out at the temperatures in the cooling stage in question.

According to the invention, the cold region of at least one cooling stage which is configured for a cryogenic temperature and is intended to serve to generate the cryogenic temperature comprises at least the devices mentioned hereinafter which, as mentioned above, are preferably introduced into a cryostat, especially into a vacuum-insulated cryostat:

- a first heat exchanger having a high pressure side for reception of the coolant mixture at high pressure level from the warm region of the cooling stage and a low pressure side for release of the coolant mixture to the warm region of the cooling stage;
- a first expansion unit configured for expansion and for cooling of the coolant mixture to low pressure level;
- a second heat exchanger configured for cooling and for partial condensation of a fraction of the coolant mixture located in a buffer volume, wherein the buffer volume is configured to limit the pressure exerted by the coolant mixture; and
- a second expansion unit configured for separation of the buffer volume from or to a connection of the buffer volume to the low pressure level of the cooling stage.

In addition, the cold region of the at least one cooling stage may preferably comprise the further devices mentioned hereinafter that are likewise preferably installed in the cryostat, especially in the vacuum-insulated cryostat:

- a third heat exchanger configured to cool an application;
- a phase separator configured to separate a biphasic coolant mixture into the liquid phase and a vaporous phase, and to separately supply the liquid phase and the vaporous phase respectively to the low pressure side of the first heat exchanger;
- a third expansion device configured to release the pressure on the low pressure side of the cooling stage into the buffer volume;
- at least one additional high pressure side and at least one additional low pressure side in the first heat exchanger for precooling and for heating of an additional coolant mixture from a downstream cooling stage;

an additional stream of matter in the first heat exchanger for cooling or for liquefaction of a gas stream to be liquefied; and conduits configured for circulation of the coolant mixture between the devices mentioned and further devices that are optionally present.

First of all, the cold region of the cooling stage in question comprises a first heat exchanger, which is especially configured as a countercurrent heat exchanger. The term "heat exchanger" refers in principle to a unit of any configuration which is configured to bring about transfer of thermal energy from at least one high-pressure stream of matter to at least one low-pressure stream of matter. The term "thermal energy" relates here to an energy in the respective stream of matter that can be described essentially as a function of the temperature of the stream of matter in question. In the context of the present invention, both the at least one high-pressure stream of matter and the at least one low-pressure stream of matter comprise a coolant mixture used here for the respective cooling stage, where the streams of matter differ from one another in a temperature of the coolant mixture(s). The at least one low-pressure stream of matter at the lowest level has a lowest temperature in each section of the heat exchanger, followed by the temperature of the at least one low-pressure stream of matter of an optional upstream stage for precooling. The at least one high-pressure stream of matter has a temperature above that of the at least one low-pressure stream of matter in each section of the heat exchanger. Moreover, the term "countercurrent heat exchanger" relates to a particular type of heat exchanger in which the high-pressure stream of matter assumes an opposite direction to the direction of the low-pressure stream of matter. It is thus advantageously possible for a particularly cold stream of matter to meet a particularly warm stream of matter, whereby a transfer of thermal energy from the at least one high-pressure stream of matter to the at least one-pressure stream of matter can be made with maximum efficiency.

The first heat exchanger encompassed in accordance with the invention by the cold region of the cooling stage in question accordingly has a first subregion referred to as "high pressure side" and a second subregion referred to as "low pressure side", with the high pressure side configured to receive the coolant mixture from the warm region of the cooling stage in question, and the low pressure side configured to receive the coolant mixture into the warm region of the cooling stage in question. The coolant mixture fed to the high pressure side from the associated warm region thus has a higher temperature compared to the coolant mixture provided on the low pressure side for release to the associated warm region. Consequently, the coolant mixture provided on the low pressure side makes a significant contribution to cooling of the coolant mixture supplied on the high pressure side from the associated warm region, and the transfer of thermal energy through the countercurrent heat exchanger used with preference can be made more efficient. In addition to the thermal energy from the high pressure side of the stage in question, the coolant mixture on the low pressure side of the stage in question can absorb thermal energy from further streams of matter, for example from the high pressure side of a downstream cooling stage or from the cooling or liquefaction of a gas stream to be cooled or liquefied.

The coolant mixture enters the first heat exchanger at high pressure level on the high pressure side, while the coolant mixture is provided at low pressure level on the low pressure side. The expression "high pressure level" refers here to the pressure level to which the attendant coolant mixture is subjected, the pressure of which has a value exceeding the pressure value to which the coolant mixture provided on the low pressure side is subjected. In particular, the high pressure level of the cooling stage here may have an absolute pressure of 1 bar, preferably of 10 bar, more preferably of 25 bar, up to 150 bar, preferably to 25 bar, more preferably to 20 bar, while the low pressure level of the cooling stage may have an absolute pressure of 100 mbar, preferably of 1 bar, more preferably of 2 bar, up to 50 bar, preferably to 10 bar, more preferably to 5 bar. However, other values both for the high pressure level and for the low pressure level are possible, especially depending on the coolant mixture used for the respective cooling stage.

In addition, the cold region of the cooling stage in question comprises a first expansion unit configured for expansion and cooling of the coolant mixture to the low pressure level. It is possible here to achieve the desired cooling of the coolant mixture preferably via the Joule-Thomson effect, with the Joule-Thomson coefficient $\mu_{JT}$ of the coolant mixture defined according to equation (1) assuming a positive value. The first expansion device thus firstly has the effect of reducing the pressure to which the coolant mixture is subjected from the high pressure level to the low pressure level, and secondly the desired further cooling of the coolant mixture. The expansion unit here may preferably be selected from an expansion valve, a throttle capillary, a diaphragm and a sintered body. However, use of a different expansion unit is conceivable.

According to the invention, the cold region of at least one cooling stage comprises a second heat exchanger configured for cooling and for partial condensation of a fraction of the coolant mixture present in a buffer volume, wherein the buffer volume is configured to limit the pressure exerted by the coolant mixture present in the cooling stage on the conduits for circulation of the coolant mixture. For this purpose, the buffer volume may comprise at least one buffer vessel which in a first preferred embodiment, is in the warm region and is connected via a conduit to a second volume present in the cold region which is thermally coupled to the second heat exchanger, or in a further preferred embodiment, is disposed in the cold region together with the second heat exchanger.

In principle, the terms "buffer", "buffer vessel" or "buffer volume" relate to a reservoir configured to provide a volume of a substance, especially for a particular purpose. In the context of the present invention, the buffer volume comprises a volume configured to receive or to release the coolant mixture, wherein the coolant mixture is received or released in accordance with the pressure generated by the coolant mixture, whereby the pressure in the refrigeration system can be kept within a fixed range of values, especially kept very substantially constant. In this way, it is possible in particular to prevent any impermissible excess pressure in the device for generating cryogenic temperatures which is also referred to as "refrigeration system". Especially in the case of a stoppage of the refrigeration system, in the case of which both balancing of pressure and balancing of temperature occur, it is possible on account of the internal volumes for a majority of the coolant mixture to be in gaseous state in the buffer vessel, while a residual fraction of the coolant mixture is distributed in pipelines and heat exchangers. In this case, there is an equal average composition of the coolant mixture in all parts of the refrigeration system, which corresponds to the filling of the device.

While the buffer vessel in refrigeration systems known from the prior art is generally disposed in the warm region, especially of the precooling stage, in order in particular firstly to enable easy accessibility of the buffer vessel and in order secondly to avoid cooling of the buffer vessel and of the substance present therein, the buffer vessel according to the present invention is either disposed in the cold region together with the second heat exchanger present in the cold region, or is disposed in the warm region and connected to the volume present in the cold region and the second heat exchanger via a conduit. This advantageously enables a setup of the second heat exchanger for cooling and for partial condensation of the fraction of the coolant mixture in the buffer volume, in order in this way to further increase the efficiency of cooling by the present device.

In a preferred embodiment, the buffer vessel present in the warm region may be connected via a conduit to the second volume present in the cold region, which is connected to the second heat exchanger, and may form a common buffer volume together therewith. In a further preferred embodiment, the second heat exchanger may be integrated in the buffer vessel present in the cold region, the word "integrated" indicating that the second heat exchanger is introduced into the buffer vessel in such a way that the buffer vessel fully encompasses the second heat exchanger, and the buffer volume corresponds to the volume of the buffer vessel minus the volume of the second heat exchanger.

In a particularly preferred embodiment of the present invention, the second heat exchanger is configured for partial condensation of at least one of the components of the coolant mixture in the buffer volume of the cooling stage in question to provide at least one condensed component. The term "partial condensation" refers here to a conversion of a portion of at least one of the components of the coolant mixture in the buffer volume of the cooling stage in question from a gaseous state to a liquid state, while the term "condensed component" describes the portion of a component of the coolant mixture that is in the liquid state in the buffer volume of the cooling stage in question. In this particularly preferred embodiment, the second heat exchanger may thus be provided in the form of a condenser, in which case the at least one condensed component may be generated by drawing enthalpy of evaporation therefrom, which is supplied to the circulating coolant mixture at low pressure level of the cooling stage in question. In this particularly preferred embodiment, the buffer volume may especially be configured such that the coolant mixture provided for the respective cooling stage that has been cooled in the first expansion device enters the second heat exchanger in such a way that only at least one of the higher-boiling components encompassed by the coolant mixture in the buffer volume condenses out of the coolant mixture in the buffer volume at first, i.e. especially at the start of a cooling phase, and hence forms a condensed component of a liquid phase present in the buffer volume.

In this particularly preferred embodiment, the present device for generating cryogenic temperatures may further comprise at least a second expansion device, especially a second expansion valve, wherein the second expansion device may preferably be configured for stepwise or continuous supply of the at least one condensed component, which at first especially comprises the at least one higher-boiling component, from the buffer volume into the conduits that serve for circulation of the coolant mixture at low pressure level. It is possible here for the second expansion device to be disposed especially between the buffer volume and the conduit through which the circulating coolant mixture flows downstream of the second heat exchanger. In this way, there may at first, i.e. especially at the start of the cooling phase, be an automatic increase in the concentration of higher-boiling components in the circulating coolant mixture. It is thus possible to increase the Joule-Thomson coefficient $\mu_{JT}$ of the coolant mixture in question, which results in more significant cooling of the coolant mixture that can lead to an overall increase in the refrigeration performance of the refrigeration system. In this way, it is possible to cool the second heat exchanger and the devices in the cold region of the present device that are arranged downstream in flow direction gradually with an increased refrigeration output compared to refrigeration systems known from the prior art. The increased refrigeration performance at the start of the cooling operation is advantageous especially in cryogenic applications since the heat capacity of the materials to be cooled is high at the start of the cooling operation, and then falls with the cube of the temperature in relation to the Debye temperature of the materials used.

In this particularly preferred embodiment, the buffer volume may advantageously also be configured such that the coolant mixture cooled in the first expansion device continues to enter the second heat exchanger, i.e. especially later on in the cooling phase, in such a way that further components of the coolant mixture gradually condense out of the coolant mixture provided in the buffer volume for the cooling stage in question with increasingly lower boiling temperature, especially the at least one lower-boiling component. It is thus possible with preference for the liquid phase present in the buffer volume to take up the at least one further-condensed component and to feed it gradually via the second expansion device to the coolant mixture at low pressure level, which results in a gradual drop in the concentration of higher-boiling components in the coolant mixture in the buffer volume and a gradual rise in the concentration of lower-boiling components in the coolant mixture in the buffer volume, i.e. especially later on in the cooling phase. The supply of the liquid phase present in the buffer volume via the second expansion device to the conduits that serve to circulate the coolant mixture at low pressure level may be stepwise or continuous. In this way, it is first possible to automatically increase the concentration of higher-boiling components in the coolant mixture of the cooling stage in question at the start of the cooling operation, proceeding from the balanced concentration in the cooling stage at rest, and then to gradually, i.e. especially later on in the cooling phase, reduce the concentration of higher-boiling components in the coolant mixture of the cooling stage in question and gradually to increase the concentration of lower-boiling components in the coolant mixture in question until the desired cooling has been effected and the cooling phase has ended. If an end of the cooling phase has thus been attained, the second expansion device may either remain open or be closed in steady-state operation of the present device.

In this particularly preferred embodiment, the buffer volume may thus be configured to enable the desired autonomous operation of the device for cryogenic temperatures in that the device can at any time be filled and operated in a sustained manner with a predefined coolant mixture configured for the respective cooling stage, with the circulating coolant mixture in the cooling stage in question having the concentration corresponding to the filling at the start of the cooling phase and then having a higher concentration of higher-boiling components as a result of the supply of higher-boiling components from the buffer volume, which is reduced gradually, i.e. during the progression of the cooling phase, in favor of the concentration of lower-boiling components.

In a further, likewise particularly preferred embodiment of the present invention, the cold region of the cooling stage in question in the present device for generating cryogenic temperatures may also have a third expansion device configured to release the pressure on the low pressure side of the cooling stage into the buffer volume. The third expansion device here may especially be configured as a backflow preventer having an entry side that opens only when the pressure on the low pressure side is greater than in the buffer volume. In this case, the third expansion device may especially be selected from a non-return valve, a non-return flap, an overflow valve and a safety valve. However, another configuration for the third expansion device is conceivable.

In a further, likewise particularly preferred embodiment of the present invention, the cold region of the cooling stage in question in the present device for generating cryogenic temperatures may also comprise a third heat exchanger configured for cooling of an application. The term "application" here relates in principle to a substance or a component, the temperature of which can be reduced by using the present device for generating cryogenic temperatures, which can also be referred to as "refrigeration system", to an above-defined cryogenic temperature. The present device is especially suitable here for liquefaction of low-boiling fluids at temperatures of 15 K to 120 K or for cooling of high-temperature superconductors or a component comprising at least one high-temperature superconductor.

The expression "high-temperature superconductor" relates here to at least one superconductive material, the superconductivity of which occurs at a temperature which is especially above 15 K. However, other substances or components may likewise serve as the application.

In a preferred embodiment, the third heat exchanger may be executed as an evaporator. The term "evaporator" here refers to a unit configured in principle for bringing a liquid component of a substance at least partly from a liquid state into a gaseous state, for which an enthalpy of evaporation is required, which can be drawn from the environment of the substance and/or of the liquid component. In the context of present invention, it is possible to evaporate at least one component of the coolant mixture in the third heat exchanger which is especially configured as an evaporator, in which case the enthalpy of evaporation required for the purpose can be taken from the application to be cooled, especially the high-temperature superconductor or the gas stream to be liquefied.

In a further, likewise particularly preferred embodiment of the present invention, the cooling stage in question in the present device for generating cryogenic temperatures may also have a phase separator configured for separation of a condensed liquid phase from a gaseous phase of the respective coolant mixture in such a way that the two phases can flow as separate low-pressure streams through the low pressure side of the first heat exchanger. The term "phase separator" refers in principle to a unit configured to separate at least two phases of a substance from one another, especially a gaseous phase from a liquid phase. In the context of the present invention, the phase separator may especially be configured to supply at least one liquid component from the coolant mixture as liquid low-pressure stream of matter directly to the low pressure side of the first heat exchanger, in order to contribute significantly there to the cooling of the coolant mixture supplied on the high pressure side from the warm region of the cooling stage in question, with the at least one gaseous component as a separate gaseous low-pressure stream likewise entering the first heat exchanger directly and in parallel with the liquid low-pressure stream and likewise contributing to cooling of the coolant mixture supplied on the high pressure side. In this way, the device is configured such that, in the case of biphasic states of the coolant mixture flowing at low pressure level during the cooling phase and in steady-state operation, the cold liquid component of the coolant mixture of the cooling stage in question can enter the low pressure side of the first heat exchanger homogeneously, which can further increase the efficiency of the cooling of the warm coolant mixture entering the first heat exchanger from the warm region of the cooling stage in question.

In the case described at the outset in which the first heat exchanger is configured in the form of a microstructured heat exchanger having a multitude of parallel microstructured flow ducts, it is not possible here for any maldistribution of the coolant mixture to occur at the cold end of the heat exchanger since strands in a parallel arrangement can cool down at the same speed. This is achieved in accordance with the invention in that a coolant mixture that is automatically first produced and provided in the first cooling stage beginning at an ambient temperature of about 300 K comprises predominantly higher-boiling components that can be liquefied at the cold end of the heat exchanger. In this way, it is possible to flood all parallel entry passages for the liquid low-pressure gas stream from the countercurrent heat exchanger with liquid coolant, as a result of which it is possible to avoid maldistribution of the coolant at the cold end of the heat exchanger. With increasing cooling of the present device, lower-boiling components are automatically added stepwise to the coolant mixture by virtue of the present invention, such that the first heat exchanger can be operated optimally later on even at cryogenic temperatures without maldistribution of the coolant at the cold end of the heat exchanger. If the optional third heat exchanger is used for cooling of an application and partial evaporation occurs therein, such that a biphasic state of the coolant mixture occurs at the exit therefrom, the phase separator and the separate low-pressure streams of matter in the first heat exchanger likewise prevent the maldistribution, and the optimal cooling of the high pressure side is achieved. This type of configuration can preferably likewise be configured in one of the downstream cooling stages of the device. It is particularly advantageous that this enables autonomous operation of the device for generating cryogenic temperatures.

In a further aspect, the present invention relates to a method for generating cryogenic temperatures, which can especially be conducted using the device described herein for generation of cryogenic temperatures. The present process comprises process steps a) to e), which can be executed for as long as desired for a volume of the coolant mixture in question, preferably as a cycle process with the sequence a), b), c), d) and e). The method can preferably be newly conducted in each case with a further volume of the coolant mixture for the cooling stage in question in the sequence specified, such that the method can be newly conducted in parallel with a further volume of the coolant mixture during or after the execution of step a) for a previously provided volume of the coolant mixture.

The individual steps of the present method for generating cryogenic temperatures are as follows:

a) introducing a coolant mixture configured for a cooling stage of a device for generating cryogenic temperatures at high pressure level from a warm region of the cooling stage into a high pressure side of a first heat exchanger, wherein the coolant mixture has at least two components having different boiling temperatures;

b) expanding and cooling the coolant mixture at low pressure level by using a first expansion device;

c) cooling and partly condensing at least one component of a fraction of the coolant mixture located in a buffer volume by using a second heat exchanger by releasing thermal energy to the coolant mixture at low pressure level, wherein the buffer volume is configured to limit the pressure exerted by the coolant mixture;

d) feeding a condensed liquid phase from the buffer volume via the second expansion unit to the coolant mixture at low pressure level, until a steady operating state or equalization of pressure between the buffer volume and the low pressure level has been achieved;

e) releasing the coolant mixture from a low pressure side of the first heat exchanger to the warm region of the cooling stage.

In addition, the present method for generating cryogenic temperatures may optionally comprise the following steps f) and g), where steps f) and g) are preferably between steps c) and e), where step d) may precede step f), follow step f) or follow step g):

f) cooling an application by using a third heat exchanger;

g) separating a biphasic coolant mixture at low pressure level into a liquid phase and a gaseous phase and separately supplying the separated liquid phase and the gaseous phase to the low pressure side of the first heat exchanger.

In step a), a coolant mixture at high pressure level is introduced from a warm region of a cooling stage of a device for generating cryogenic temperatures, especially of the device described herein for generating cryogenic temperatures, into a high pressure side of a first heat exchanger, preferably a countercurrent heat exchanger, as a result of which the coolant mixture in question is cooled to a lower temperature compared to the warm region of the cooling stage. Cooling is accomplished here by using an already previously used volume of coolant mixture which is introduced in step d) into the low pressure side of the first heat exchanger, preferably the countercurrent heat exchanger. As described above, the coolant mixture comprises at least two components having different boiling temperatures.

In step b), the coolant mixture is expanded and cooled to low pressure level by using a first expansion unit, as a result of which the coolant mixture is now at low pressure and a lower temperature compared to the exit from the first heat exchanger.

According to the invention, in step c), at least one component of a fraction of the coolant mixture present in a buffer volume is cooled and partly condensed to low pressure level by using a second heat exchanger by release of thermal energy to the coolant mixture flowing through the second heat exchanger, which flows through the second heat exchanger after the first expansion unit, which especially forms a liquid phase having at least one higher-boiling component at the base of the buffer volume.

According to the invention, in addition, the following step d) is executed, in which a condensed liquid phase is fed from the buffer volume by using the second expansion unit stepwise or continuously to the coolant mixture at low pressure level, until a steady operating state or equalization of pressure between the buffer volume and the low pressure level is achieved. In this way, it is possible at the start of the cooling operation to increase the concentration of higher-boiling components in the coolant mixture of the stage and hence to is achieve higher cooling performance, while a higher concentration of lower-boiling components in the coolant mixture from the stage and hence a lower temperature, preferably a cryogenic temperature, can be achieved toward the end of the cooling operation and in steady-state operation.

In this embodiment, the feeding of the at least one condensed component into the conduits for circulation of the coolant mixture at low pressure level may bring about a change in a current concentration of the components in the respective coolant mixture. The change in the current concentration of the components in this coolant mixture can preferably be effected here in such a way that at least one higher-boiling component of the coolant mixture and increasingly at least one lower-boiling component of the coolant mixture are condensed.

In step e), the coolant mixture is then released from a low pressure side of the first heat exchanger to the warm region of the cooling stage, but can be used here to cool a further volume of coolant mixture provided in step a) for the first time by using the first heat exchanger, preferably the countercurrent heat exchanger.

In a preferred embodiment of the present method, in an additional step f), an application can be cooled by using a third heat exchanger. As already mentioned above, the application may especially comprise a cooling or liquefaction of low-boiling fluids at a temperature of preferably 15 K to 120 K, or cooling of high-temperature superconductors or of a component having at least one high-temperature superconductor to a temperature of preferably 15 K to 90 K.

In a further, likewise preferred embodiment of the present method, preferably during the above-described cycle process, step g) may additionally be executed, wherein the separation of a biphasic coolant mixture at low pressure level can preferably be effected by using a phase separator into a liquid phase and a gaseous phase, which can be supplied to the first heat exchanger as separate low-pressure streams of matter and hence can flow separately in parallel through the first heat exchanger on the low pressure side, which can ensure homogeneous flow and cooling and a high efficiency of the first heat exchanger.

Furthermore, the present method for generating cryogenic temperatures may optionally comprise at least one further step, especially selected from:

precooling and heating and additional coolant mixture from a downstream cooling stage and at least one additional high pressure side and at least one additional low pressure side in the first heat exchanger, cooling or liquefying a gas stream to be liquefied in an additional stream of matter in the first heat exchanger.

For further details in relation to the present method, reference is made to the description of the device of the invention.

In a further aspect, the present invention relates to a use of a device for generating cryogenic temperatures. As already mentioned above, the use may more preferably be selected from a liquefaction of low-boiling fluids at temperatures of 15 K to 120 K and cooling of high-temperature superconductors to temperatures of 15 K to 90 K.

For further details in relation to the present use, reference is made to the description of the device of the invention.

BRIEF DESCRIPTION OF THE FIGURES

Further details and features of the present invention will be apparent from the description of preferred working examples that follows, especially in conjunction with the dependent claims. It is possible here for the respective features to be implemented on their own, or two or more in combination. However, the invention is not limited to the working examples. The working examples are shown schematically in the figures that follow. In this context, identical reference numerals in the figures denote elements that are the same or have the same function, or elements that correspond to one another in terms of their function.

The individual figures show.

DESCRIPTION OF THE WORKING EXAMPLES

Figure 1:
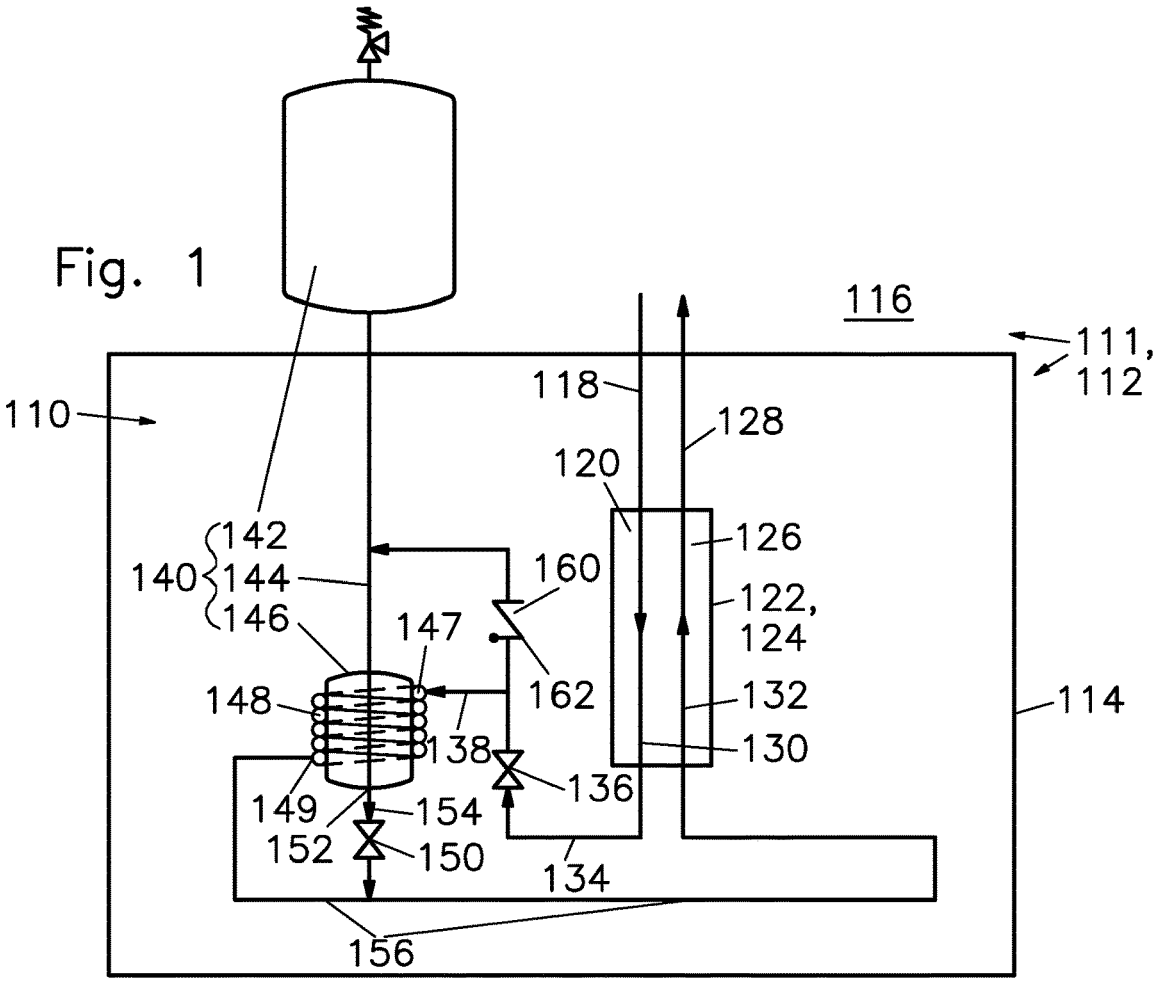
FIGS. 1 to 5 a schematic diagram in each case of a cold region of a preferred working example of a device of the invention for generation of cryogenic temperatures.
Figure 2:
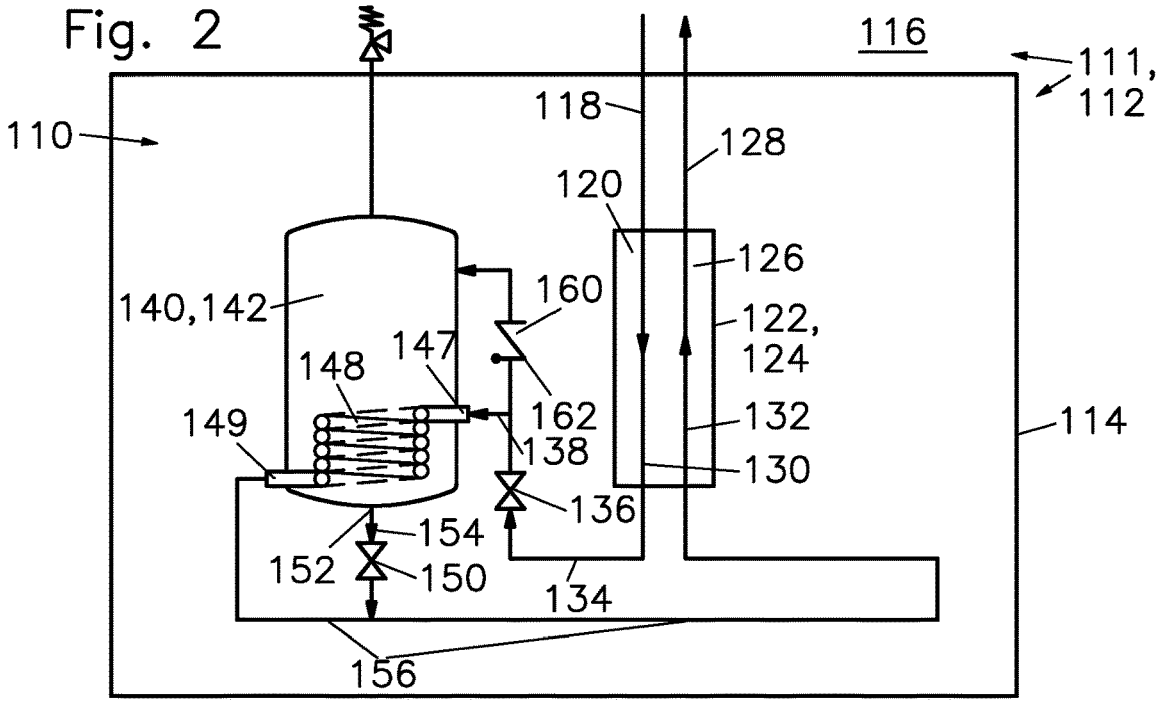

FIGS. 1 to 5 each show a schematic diagram of a preferred working example of a cold region 110 of a cooling stage 111 of a device 112 for generation of cryogenic temperatures, which can also be referred to as "refrigeration system". As mentioned above, the expression "cryogenic temperature" relates to a temperature of 10 K, preferably of 15 K, up to 120 K, preferably to 90 K. The cold region 110 of the cooling stage 111 has preferably been introduced into a vacuum-insulated cryostat 114.

As well as the cold region 110, the cooling stage 111 of the device 112 also comprises a warm region 116 that has a higher temperature compared to the cold region 110. The device 112 shown in each of FIGS. 1 to 5 is in a one-stage configuration and hence comprises the exactly one cooling stage 111 with the cold region 110 and the warm region 116. In the executions of FIGS. 1 to 5, the warm region 116 of the cooling stage 111 is preferably configured for ambient temperature and is typically kept at ambient temperature. Reference is made to the above definition for the term "ambient temperature".

In the warm region 116, a coolant mixture comprising a mixture of at least two components of coolants that has been configured for the cooling stage 111 is provided, where at least two of the components have a different boiling temperature. In order to be able to achieve maximum efficiency in cooling of the coolant mixture from the ambient temperature to the cryogenic temperature, a wide-boiling coolant mixture is used that comprises both at least one higher-boiling component and at least one lower-boiling component. As mentioned above, the at least one higher-boiling component may preferably be selected from a hydrocarbon and a fluorinated hydrocarbon, while the at least one lower-boiling component may preferably be selected from oxygen, nitrogen, argon, neon, hydrogen and helium. However, other substances are possible.

The warm coolant mixture is introduced at high pressure level from the warm region 116 into the cold region 110 by using a feed 118 that opens into a high pressure side 120 of a first heat exchanger 122, which, in the illustrative diagram of FIG. 1, is executed as a countercurrent heat exchanger 124. In addition, the first heat exchanger 122 has a low pressure side 126 which is designed for release of the cold coolant mixture to the warm region 116 by using a drain 128. Thus, the warm coolant mixture fed in from the warm region 116 on the high pressure side 120 has a higher temperature compared to the coolant mixture provided for release to the warm region 116 on the low pressure side 126. Consequently, the cold coolant mixture provided on the low pressure side 126 makes a significant contribution to the cooling of the warm coolant mixture fed in from the warm region 116 on the high pressure side 120, and a transfer of thermal energy via the countercurrent heat exchanger 124 can be made more efficient in that the warm coolant mixture fed in from the warm region 116 on the high pressure side 120 flows in an opposite direction 130 from a direction 132 of the cold coolant mixture provided on the low pressure side 126.

The warm coolant mixture that has already been partly cooled in the first heat exchanger 122 on the high pressure side 120 and has originally been fed in from the warm region 116 subsequently passes via a conduit 134 into a first expansion unit 136, designed here as an expansion valve. However, an alternative execution of the expansion unit 136 as a throttle capillary, diaphragm or sinter element is possible. The first expansion unit 136 is likewise in the cold region 110 and is configured for cooling of the coolant mixture to low pressure level. The expansion valve 136 here may preferably be configured to achieve the desired cooling of the coolant mixture by using the Joule-Thomson effect, since the coolant mixture for the cooling stage 111 has been adjusted such that the Joule-Thomson coefficient $\mu_{JT}$, defined according to equation (1), of the coolant mixture has a positive value at the temperature of the cold side 110 of the cooling stage 111. Thus, the first expansion valve 136 firstly brings about the reduction in the pressure to which the coolant mixture is subject from the high pressure level to low pressure level, and secondly the desired further cooling of the coolant mixture.

The further-cooled and expanded coolant mixture subsequently passes via a further conduit 138 and an inlet 147 into a second heat exchanger 148, and exits from the second heat exchanger 148 at an outlet 149. In the executions according to FIGS. 1 and 3 to 5, the second heat exchanger 148 is thermally coupled to a second volume 146. The second volume 146 is part of a buffer volume 140 configured to limit the pressure exerted by the coolant mixture. In the executions according to FIGS. 1 and 3 to 5, the buffer volume 140 comprises a buffer vessel 142 which is disposed in the warm region 116 of the device 112 and is connected to the second volume 146 via a conduit 144. By contrast, in the execution according to FIG. 2, the buffer vessel 142 is likewise disposed in the cold region 110, with the second heat exchanger 148 integrated into the buffer vessel 142 and hence introduced into the buffer vessel 142 in such a way that the buffer vessel 142 fully encompasses the second heat exchanger 148.

The second heat exchanger 148 is configured for cooling and partial condensation of the coolant mixture in the buffer volume 140, in order in this way to further increase the efficiency of the cooling by the present device. In the particularly preferred one-step execution of the device 112 shown in schematic form in FIGS. 1 to 5, the second heat exchanger 148 is configured for partial condensation of at least one of the components of a portion of the coolant mixture present in the buffer volume 140 to provide at least one condensed component. For this purpose, the second heat exchanger 148 may preferably be provided in form of a condenser, in which case the at least one condensed component is generated in the buffer volume 140 by drawing enthalpy of evaporation from the condensed component, which is supplied to the circulating coolant mixture at low pressure level between the inlet 147 and the outlet 149 of the second heat exchanger 148. In this execution, the coolant mixture cooled down in the first expansion valve 136 enters the second heat exchanger 148 in such a way that only at least one higher-boiling component condenses out of the portion of the coolant mixture present in the buffer volume 140 at first, i.e. on commencement of the cooling phase, and this forms a condensed component in the form of a liquid phase (not shown).

In the executions according to FIGS. 1 to 5, the cold region 110 of the device 112 comprises a second expansion unit 150 that serves for stepwise or continuous supply of the liquid phase formed or present in the buffer volume 140 into a further conduit 156 for circulation of the coolant mixture at low pressure level. The second expansion unit 150 is likewise executed here as an expansion valve; however, an alternative execution as a combination of a magnetic valve and a throttle capillary, diaphragm or sinter element is possible.

As shown in schematic form by FIGS. 1 to 5, the second expansion unit 150 is especially disposed at an outlet 152 from the buffer volume 140 in a conduit 154. The expansion unit 150 may be closed at the start of the cooling operation until formation of a liquid phase in the buffer volume 140. The opening of the expansion device 150 allows the liquid phase to be fed fully or partly from the buffer volume 140 via conduit 154 to the coolant mixture circulating in conduit 156. In this way, especially on commencement of the cooling phase, proceeding from the balanced concentration corresponding to the filling of the cooling stage at rest, there may be an automatic increase in the concentration of higher-boiling components in the circulating coolant mixture for the stage. It is thus possible to increase the Joule-Thomson coefficient $\mu_{JT}$ of the coolant mixture, which results in more significant cooling of the coolant mixture that can lead to an overall increase in refrigeration performance of the refrigeration system. It is thus possible to gradually cool units in the cold region 110 of the device 112 that follow downstream in flow direction with an elevated refrigeration performance compared to refrigeration systems known from the prior art.

The expansion unit 150 may subsequently be closed or have such dimensions that a liquid phase forms again in the buffer volume 140 upstream of the outlet 152, or a liquid phase is present continuously. In the further cooling phase, the liquid phase formed or present in the buffer volume 140 may preferably absorb the at least one further-condensed component. The liquid phase present in the buffer volume 140 may also additionally be fed fully or partly via the second expansion unit 150 stepwise or continuously to the conduit 156 for circulation of the coolant mixture at low pressure level. Later on in the cooling phase, there is a gradual drop in the concentration of higher-boiling components in the coolant mixture in the buffer volume 140 and a gradual rise in the concentration of lower-boiling components in the coolant mixture in the buffer volume 140. It is thus possible to gradually and automatically reduce the concentration of higher-boiling components in the circulating coolant mixture again later on in the cooling phase, and gradually increase the concentration of lower-boiling components in the coolant mixture again, until the cooling phase has ended. Once the cooling phase had ended, the second expansion unit 150 may be closed or remain open in order to establish steady-state operation of the device 112.

In the executions according to FIGS. 1 to 5, the buffer volume 140 may thus be configured to enable the desired autonomous operation of the device 112 in that the apparatus 112 can be filled at any time with a predefined coolant mixture and operated sustainably, where the circulating coolant mixture at the start of the cooling phase has the balanced concentration corresponding to the filling of the cooling stage, then has a higher concentration of higher-boiling components as a result of the supply of higher-boiling components from the buffer volume 140, which is reduced again gradually, i.e. during the cooling phase, in favor of the concentration of lower-boiling components.

As is also shown schematically in FIGS. 1 to 5, the device 112 may also have, in the cold region 110, a third expansion unit 160 configured to release the pressure on the low pressure side of the cooling stage 111 into the buffer volume 140. In FIGS. 1 to 5, the expansion unit 160 is preferably connected to the conduit 138; however, connection to any other suitable conduit on the low pressure side of the cooling stage 111 is possible. The third expansion unit 160 may especially be configured as a backflow preventer having an entry side 162 indicated by a dot, which opens only when the pressure on the low pressure side is greater than in the buffer volume 140. The third expansion unit 160 may especially be selected from a nonreturn valve, a nonreturn flap, an overflow valve and a safety valve; however, a different execution is possible. The third expansion unit 160 may therefore preferably be used as safety unit for pressure safeguarding of the low pressure side, for example in the case of occurrence of a quench of a superconductor application or a break in the insulation vacuum.

The coolant mixture that circulates in the conduit 156 shown in schematic form in FIGS. 1 to 5 can ultimately enter the low pressure side 126 of the first heat exchanger 122, whence it is released to the warm region 116 of the cooling stage 111.

Figure 3:
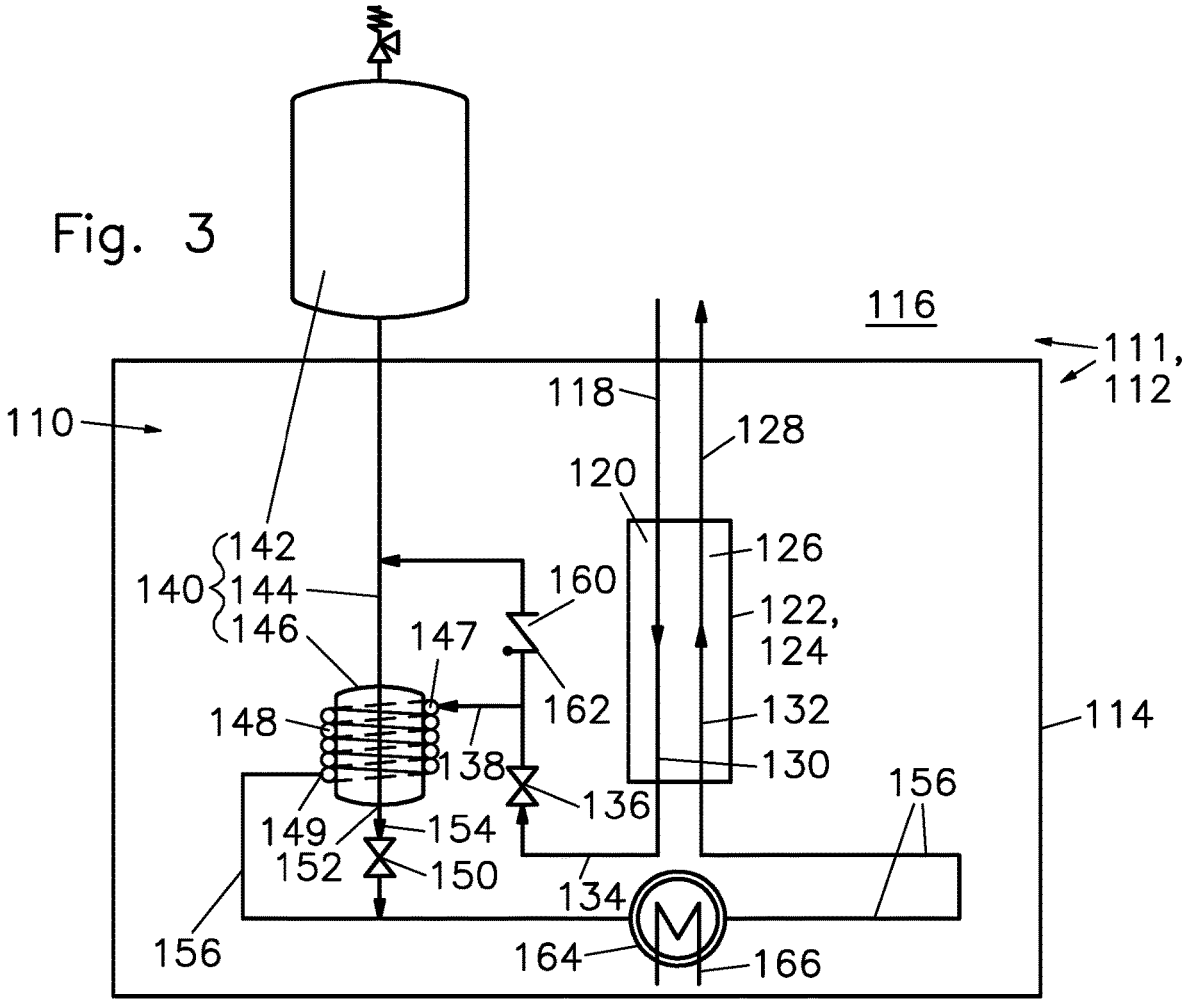
Figure 5:
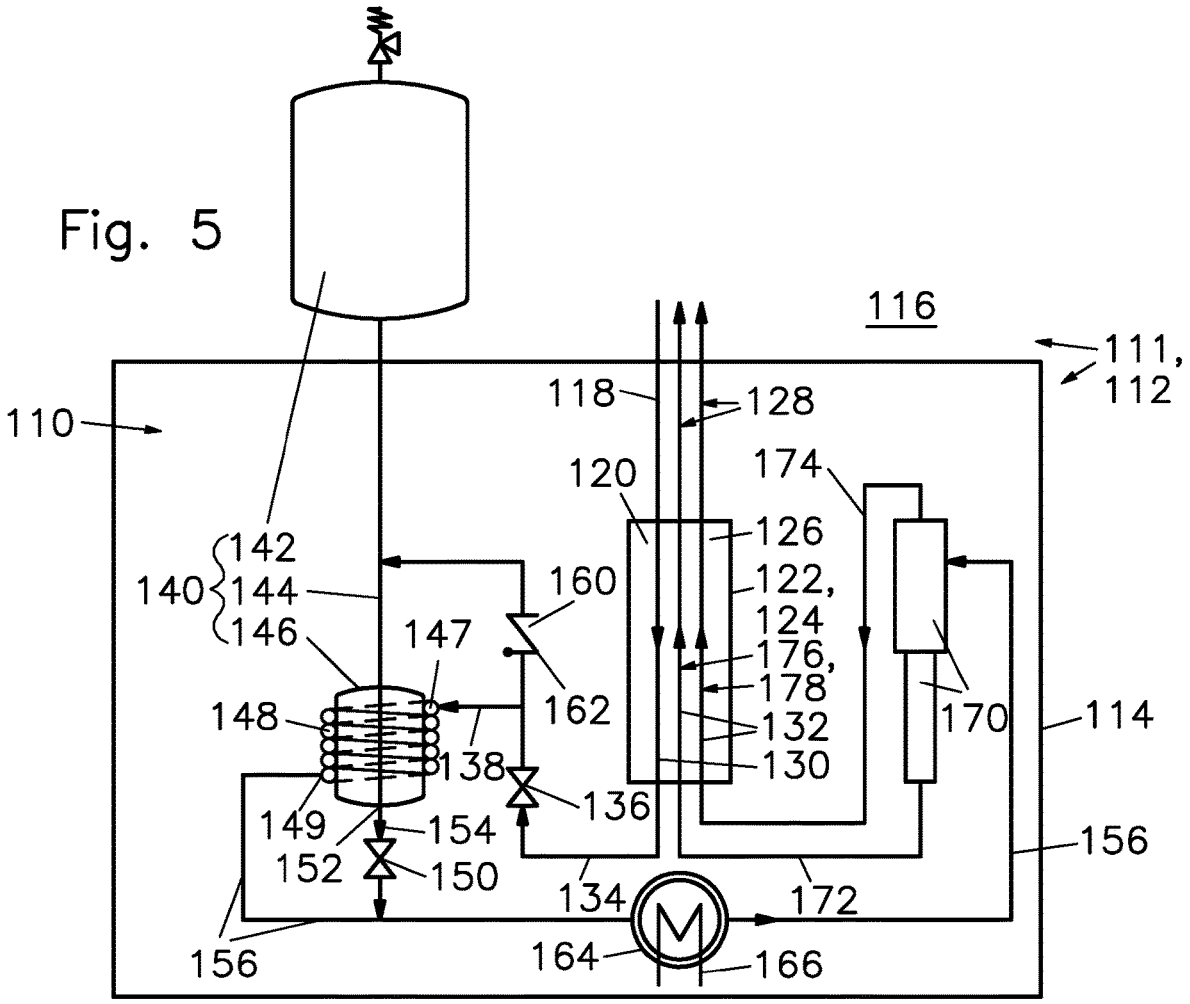

As also shown schematically in FIGS. 3 and 5, the device 112 in the cold region 110 may also have a third heat exchanger 164 which has been introduced into the conduit 156 for circulation of the coolant mixture and which is configured for cooling of application 166, wherein the application 166 comprises a substance or a component, the temperature of which can be reduced to a cryogenic temperature by using the device 112. The third heat exchanger 164 here is preferably designed as an evaporator, wherein at least one component of the circulating coolant mixture is partly evaporated at low pressure level in that the requisite enthalpy of evaporation is drawn from the application 166 to be cooled. However, other executions of the third heat exchanger 164 are conceivable.

Figure 4:
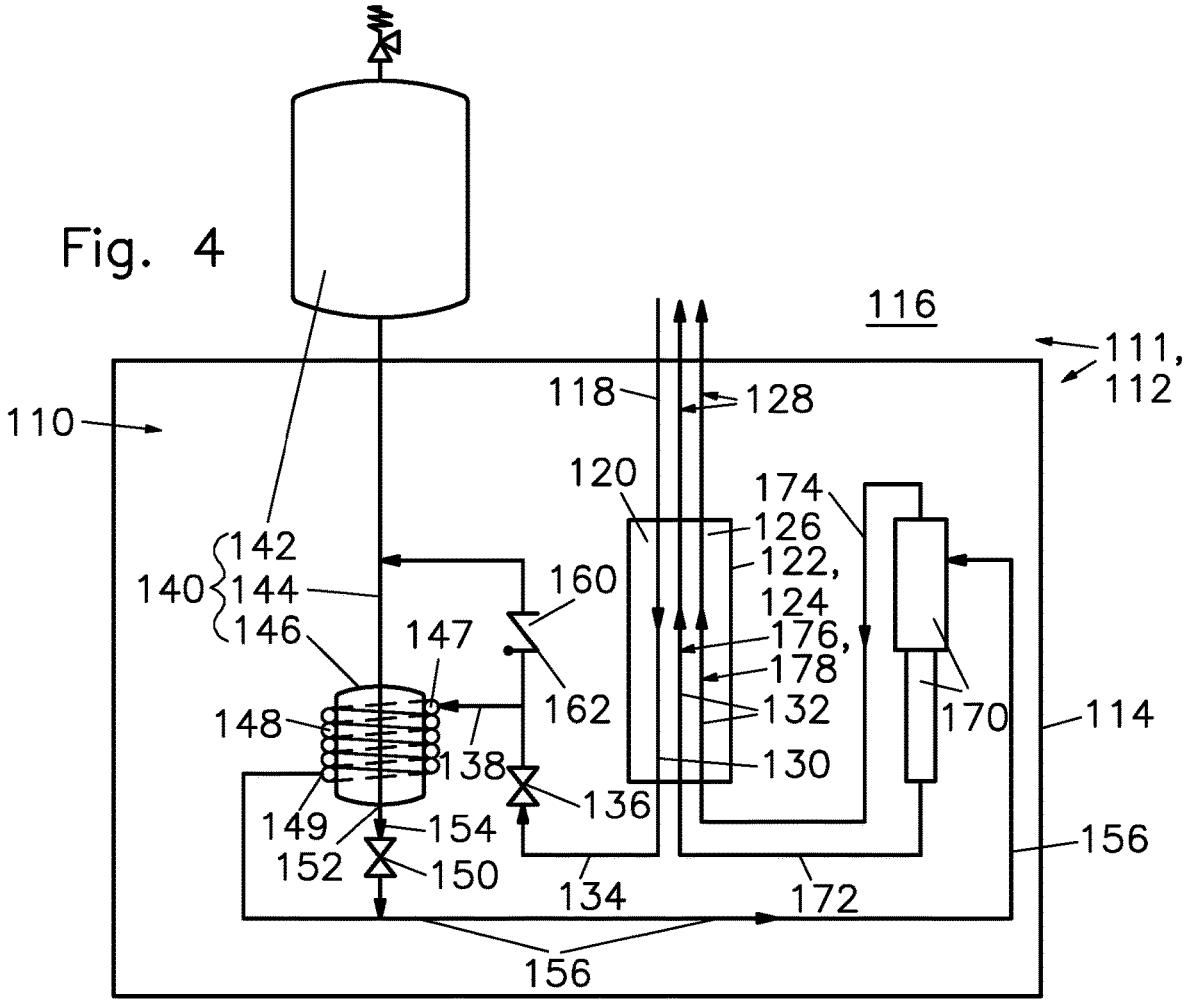

As also shown schematically in FIGS. 4 and 5, the device 112 may also have, in the cold region 110, a phase separator 170 configured to separate a biphasic coolant mixture which is formed by partial evaporation in the second heat exchanger 148 and/or in the third heat exchanger 164 into the liquid phase and a vaporous phase, and for separate supply of each of the liquid phase and the vaporous phase to the low pressure side 126 of the first heat exchanger 122. As shown schematically by FIGS. 4 and 5, the liquid phase is fed by using a conduit 172 to a first low-pressure stream 176, and the vaporous phase by using a separate conduit 174 to a second low-pressure stream 178 on the low pressure side 126 of the first heat exchanger 122. In this case, the first low-pressure stream 176 absorbed by the liquid phase with the higher refrigeration output by virtue of the enthalpy of evaporation from the biphasic coolant mixture is preferably run closer to the high pressure side 120 which is configured for cooling of the coolant mixture from the warm region 116 via the conduit 118 in the first heat exchanger 122 in the cold region 110. Thus, the cold region 110 of the cooling stage 111 of the device 112 is configured such that, even during the cooling phase, it is predominantly the cold liquid component of the coolant mixture that is used to cool the warm coolant mixture entering the first heat exchanger 122 from the warm region 116, as a result of which the efficiency of the cooling of the device 112 can be increased further. The cold gaseous component of the coolant mixture likewise contributes to a lesser degree, via the second low-pressure stream 178 on the low pressure side 126 of the first heat exchanger 122, to the cooling of the warm coolant mixture entering the first heat exchanger 122 from the warm region 116.

This is especially true in the case described at the outset, in which the first heat exchanger 122 is executed in the form of a microstructured heat exchanger having a multitude of parallel microstructured flow ducts, in which strands in a mutually parallel arrangement can be cooled at the same speed. This is achieved in accordance with the invention in that, during the cooling phase, a coolant mixture comprising predominantly higher-boiling components that can be liquefied at the cold end of the heat exchanger 122 is first produced and provided automatically. In this way, all parallel entry passages of the first low-pressure stream 176 on the low pressure side 126 of the heat exchanger 122 may be flooded with liquid coolant, which can prevent maldistribution of the coolant at the cold end of heat exchanger 122. With increasing cooling of the cold region 110 of the device 112, lower-boiling components are automatically added stepwise to the coolant mixture by virtue of the inventive configuration of the buffer volume 140, such that the first heat exchanger 122 can also be operated optimally at cryogenic temperatures later on without maldistribution of the coolant at the cold end of the heat exchanger 122. In a particularly advantageous manner, this enables autonomous operation of the device for generating cryogenic temperatures.

Figure 6:
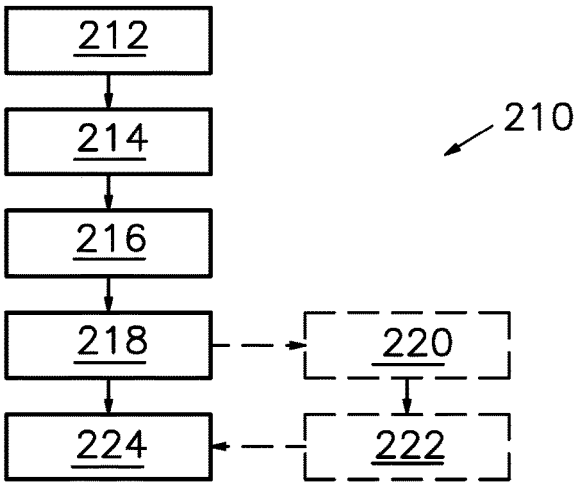
FIG. 6 a schematic diagram of a preferred working example of a method for the invention for generation of cryogenic temperatures.

FIG. 6 shows a schematic diagram of a preferred working example of a method 210 for generating cryogenic temperatures, which can especially be conducted using the device 112 described herein.

In a provision step 212, a coolant mixture, in step a), at high pressure level from the warm region 116 of the cooling stage 111 of the device 112 for generation of cryogenic temperatures is introduced into the high pressure side 120 of the first heat exchanger 122, preferably of the countercurrent heat exchanger 124, where it is cooled down to a lower temperature compared to the warm region 116.

In an expansion step 214, in step b), the coolant mixture is expanded and cooled to low pressure level by using a first expansion unit 136, as a result of which the coolant mixture is now at low pressure and a lower temperature compared to the high-pressure outlet of the first heat exchanger 122.

In a condensation step 216, in step c), at least one component of the fraction of the coolant mixture present in the buffer volume 140 is cooled and partly condensed by using the second heat exchanger 148 by release of thermal energy to the coolant mixture at low pressure level that flows through the second heat exchanger 148 downstream of the first expansion device 136.

In a supplying step 218, in step d), a condensed liquid phase from the buffer volume 140 is fed stepwise or continuously via the second expansion unit 150 to the circulating coolant mixture at low pressure level, until a steady operating state or equalization of pressure between the buffer volume 140 and the low pressure level has been attained.

In an optional application step 220, in the additional step f), the application 166 may be cooled by using the third heat exchanger 164, the desirability of which depends on the use of the device 112. As mentioned above, the application 166 here may especially be a liquefaction of low-boiling fluids at a temperature of 15 K to 120 K, or cooling of high-temperature superconductors or of a component having at least one high-temperature superconductor to a temperature of 15 K to 90 K.

In an optional but particularly preferred separation step 222, in the additional step g), a biphasic coolant mixture at low-pressure level may be separated into the liquid phase and the gaseous phase, which can preferably be accomplished using the phase separator 170, in which case it is additionally possible to separately supply the separated liquid phase and gaseous phase in conduits 170, 174 to low-pressure streams 176, 178 on the low pressure side 126 of the first heat exchanger 122.

In a release step 224, in step e), the coolant mixture is then released from the low pressure side 126 of the first heat exchanger 122 to the warm region 116, and may be used here, as described above, to cool a further volume of coolant mixture provided in the provision step 212 for the first time by using the first heat exchanger 122, preferably the countercurrent heat exchanger 124.

In addition, the present method 210 for generating cryogenic temperatures may optionally comprise at least one further step (not shown), especially selected from:

- precooling and heating an additional coolant mixture from a downstream cooling stage in at least one additional high pressure stage and at least one additional low pressure stage in the first heat exchanger 122,
- cooling or liquefying a gas stream to be liquefied in an additional stream of matter in the first heat exchanger 122.

For further details of the present method 210, reference is made to the above description of the device 112.

LIST OF REFERENCE NUMERALS

110 cold region
111 cooling stage
112 device for generating cryogenic temperatures
114 (vacuum-insulated) cryostat
116 warm region
118 feed
120 high pressure side
122 first heat exchanger
124 countercurrent heat exchanger
126 low pressure side
128 drain
130 direction
132 direction
134 conduit
136 first expansion unit
138 conduit
140 buffer volume
142 buffer vessel
144 conduit
146 second conduit
147 inlet
148 second heat exchanger
149 outlet
150 second expansion unit
152 outlet
154 conduit
156 conduit
160 third expansion unit
162 entry side
164 third heat exchanger
166 application
170 phase separator
172 conduit

174 conduit
176 first low-pressure stream
178 second low-pressure stream
210 method for generating cryogenic temperatures
212 provision step
214 expansion step
216 condensation step
218 supplying step
220 application step
222 separation step
224 release step

The invention claimed is:

1. A device for generating cryogenic temperatures, comprising at least one cooling stage having a cold region and a warm region, wherein a coolant mixture configured for the respective cooling stage is provided in the warm region, wherein the coolant mixture has at least two components having different boiling temperatures, wherein the cold region of at least one cooling stage comprises:

a first heat exchanger having a high pressure side for reception of the coolant mixture at a high pressure level from the warm region of the cooling stage and a low pressure side for release of the coolant mixture to the warm region of the cooling stage;

a first expansion unit configured for expansion and for cooling of the coolant mixture to a low pressure level, wherein the high pressure level is higher than the low pressure level, wherein the cooling stage has the low pressure level;

a second heat exchanger configured for cooling and for partial condensation of a fraction of the coolant mixture located in a buffer volume, wherein the buffer volume is configured to limit the pressure exerted by the coolant mixture; and a second expansion unit fluidly coupled to the buffer volume, wherein the second expansion unit is configured to supply at least one condensed component of the coolant mixture condensed in the buffer volume to the low pressure side of the first heat exchanger.

2. The device of claim 1, wherein the second heat exchanger is configured for partial condensation of at least one of the components of the fraction of the coolant mixture in the buffer volume to provide at least one condensed component.

3. The device of claim 1, wherein the buffer volume comprises a buffer vessel, wherein the buffer vessel is in the warm region and is connected via a conduit to a second volume which is present in the cold region and is thermally coupled to the second heat exchanger, or wherein the buffer vessel is in the cold region and the second heat exchanger is integrated into the buffer vessel.

4. The device of claim 1, further comprising a third expansion unit configured to relieve the pressure on the low pressure side of the cooling stage.

5. The device of claim 1, further comprising a third heat exchanger configured to cool an application.

6. The device claim 1, further comprising a phase separator configured to separate a biphasic coolant mixture into a liquid phase and a vaporous phase, and for separate feeding of the liquid phase to a first low-pressure stream and of the vaporous phase to a second low-pressure stream on the low pressure side of the first heat exchanger.

7. The device of claim 1, wherein device for generating cryogenic temperatures is a vacuum-insulated cryostat.

* * * * *